US010126081B1

(12) United States Patent
Geissele

(10) Patent No.: US 10,126,081 B1
(45) Date of Patent: Nov. 13, 2018

(54) SAFETY SELECTOR ASSEMBLY

(71) Applicant: WHG Properties, LLC, North Wales, PA (US)

(72) Inventor: William H. Geissele, Lower Gwynedd, PA (US)

(73) Assignee: WHG Properties, LLC, North Wales, PA (US)

( * ) Notice: Subject to any disclaimer, the term of this patent is extended or adjusted under 35 U.S.C. 154(b) by 0 days.

(21) Appl. No.: 15/795,857

(22) Filed: Oct. 27, 2017

(51) Int. Cl.
*F41A 17/46* (2006.01)

(52) U.S. Cl.
CPC ..... *F41A 17/46* (2013.01)

(58) Field of Classification Search
CPC ..... F41A 17/46; F41A 17/56; F41A 17/64; F41A 17/74
USPC ..... 42/70.06
See application file for complete search history.

(56) References Cited

U.S. PATENT DOCUMENTS 8,276,502 B1 * 10/2012 Wright ..... F41A 17/46 42/70.01
8,549,982 B2 * 10/2013 Troy, Jr. ..... F41A 35/06 89/132
8,806,790 B1 * 8/2014 Huang ..... F41A 17/74 42/70.08
9,003,948 B2 * 4/2015 Brown ..... F41A 19/33 42/70.01
9,587,897 B1 * 3/2017 Huang ..... F41A 17/00
9,784,518 B2 * 10/2017 Geissele ..... F41A 19/46
9,829,262 B1 * 11/2017 Suttie ..... F41A 17/46
2008/0302235 A1 * 12/2008 Lauck ..... F41A 17/46 89/132
2012/0325044 A1 * 12/2012 Brown ..... F41A 19/33 74/548
2013/0111796 A1 * 5/2013 Dionne ..... F41A 17/00 42/70.11
2016/0018176 A1 * 1/2016 Fellows ..... F41A 19/02 42/69.03
2016/0091268 A1 * 3/2016 Miller, III ..... F41A 17/46 42/70.06
2016/0131449 A1 * 5/2016 Horch ..... F41A 19/16 42/69.01
2016/0187092 A1 * 6/2016 Mather ..... F41A 19/10 42/69.02
2017/0089655 A1 * 3/2017 Geissele ..... F41A 19/46
2017/0122686 A1 * 5/2017 Fellows ..... F41A 19/24
2017/0176122 A1 * 6/2017 Underwood ..... F41A 19/46
2017/0299304 A1 * 10/2017 Otte, Jr. ..... F41A 17/46

OTHER PUBLICATIONS

Israel Weapon Industries (IWI), Tavor Assault Rifle—Armorer's Manual, Apr. 2007, 144 pages.

* cited by examiner

*Primary Examiner* — Joshua E Freeman
(74) *Attorney, Agent, or Firm* — Fox Rothschild LLP

(57) ABSTRACT

A safety selector assembly for a firearm includes a cylinder sized and shaped to be rotatably received within a lower receiver. The cylinder includes a cylinder end having a recess defined therein, and a plunger disposed at least partially within the recess. The plunger is moveably secured within the recess by a pin. The safety selector assembly also includes a lever detachably coupled to the cylinder end by the plunger.

20 Claims, 10 Drawing Sheets

SAFETY SELECTOR ASSEMBLY

INTRODUCTION

Firearms are configured to fire rounds of ammunition. To fire a firearm, the user of the firearm can pull a trigger assembly, which releases a hammer. The hammer is designed to then strike a firing pin which, in turn, strikes an impact sensitive round of ammunition. Once struck, the round of ammunition expels a bullet from the barrel of the firearm toward a target.

In some firearms, the trigger assembly may be selectively placed in one of two modes: a safety mode, in which the trigger assembly cannot be operated; and a fire mode, in which the trigger assembly can be operated to fire the round of ammunition. In other firearms, the trigger assembly may be selectively placed in one of three modes: a safety mode; a semi-automatic fire mode, in which the trigger assembly can be operated to fire a single round with each pull of the trigger; and an automatic fire mode, in which the trigger assembly can be operated to fire a plurality of rounds while the trigger bow is maintained in the pulled position. A safety selector assembly may be provided to operatively engage with the trigger assembly and selectively place the firearm in the various modes as described above. However, to facilitate firearm ease of use, the safety selector assembly and/or safety selector levers should be configured for quick and easy installation and/or removal from the firearm.

SUMMARY

The present disclosure relates generally to safety selector assemblies for firearms.

In one aspect, the disclosed technology relates to a safety selector assembly for a firearm, including: a cylinder sized and shaped to be rotatably received within a lower receiver, the cylinder comprising a cylinder end having a recess defined therein; a plunger disposed at least partially within the recess, wherein the plunger is moveably secured within the recess by a pin; and a lever detachably coupled to the cylinder end by the plunger. In one embodiment, the cylinder defines a rotational axis and the recess extends along the rotational axis. In another embodiment, the plunger is biased along the rotational axis within the recess by a biasing element. In another embodiment, the lever includes a head portion having a plunger recess defined therein, and wherein when the head portion is coupled to the cylinder end at least a portion of the plunger extends into the plunger recess so as to secure the lever to the cylinder. In another embodiment, the pin extends in a direction that is substantially orthogonal to the rotational axis. In another embodiment, the pin prevents the plunger and the biasing element from being removed from the recess. In another embodiment, the plunger comprises an outer surface having an annular groove defined therein, the annular groove receiving at least a portion of the pin so as to moveably secure the plunger within the recess. In another embodiment, the annular groove has a length defined along a rotational axis of the cylinder, and wherein the length of the annular groove defines the amount of movement of the plunger when secured within the recess. In another embodiment, an opening sized and shaped to support the pin is defined within the cylinder. In another embodiment, the cylinder further includes an annular channel adjacent to the cylinder end, and the opening is positioned within the annular channel. In another embodiment, the opening extends through the cylinder. In another embodiment, the cylinder end is a first cylinder end and the cylinder further includes an opposite second cylinder end having a second recess defined therein, and wherein the safety selector assembly further includes: a second plunger disposed at least partially within the second recess, wherein the second plunger is moveably secured within the second recess by a second pin; and a second lever detachably coupled to the second cylinder end by the second plunger.

In another aspect, the disclosed technology relates to a firearm including: a lower receiver configured to house a trigger assembly; and a safety selector assembly rotatably supported at least partially within the lower receiver, wherein the safety selector assembly is operably coupled to the trigger assembly, the safety selector including: a cylinder defining a rotational axis and including a cylinder end having a recess defined therein; a plunger biased at least partially within the recess, wherein the plunger is moveably secured within the recess by a pin; and a lever detachably coupled to the cylinder end by the plunger, wherein the lever is disposed on an exterior of the lower receiver when the safety selector is rotatably coupled thereto. In one embodiment, the pin is supported by the cylinder and is oriented substantially orthogonal to the rotational axis.

In another aspect, the disclosed technology relates to a method of assembling a safety selector assembly for a firearm including: positioning a plunger at least partially within a recess defined in a cylinder end of a cylinder, wherein the cylinder is sized and shaped to be rotatably received within a lower receiver; moveably securing the plunger within the recess by a pin; and detachably coupling a lever to the cylinder end via the plunger. In one embodiment, the cylinder defines a rotational axis and the method further includes biasing the plunger along the rotational axis within the recess. In another embodiment, moveably securing the plunger within the recess further includes: depressing the plunger within the recess; and pressing the pin into the cylinder such that the pin at least partially extends within an annular groove defined on the plunger. In another embodiment, pressing the pin into the cylinder further includes orienting the pin substantially orthogonally to the rotational axis. In another embodiment, detachably coupling the lever to the cylinder further includes: depressing the plunger within the recess; and sliding a head portion of the lever onto the cylinder end. In another embodiment, the method further includes inserting at least a portion of the cylinder into a receiver of the firearm.

A variety of additional aspects will be set forth in the description that follows. The aspects can relate to individual features and to combinations of features. It is to be understood that both the foregoing general description and the following detailed description are exemplary and explanatory only and are not restrictive of the broad inventive concepts upon which the embodiments disclosed herein are based.

BRIEF DESCRIPTION OF THE DRAWINGS

The following drawings are illustrative of particular embodiments of the present disclosure and do not limit the scope of the present disclosure. The drawings are not to scale and are intended for use in conjunction with the explanations provided herein. Embodiments of the present disclosure will hereinafter be described in conjunction with the appended drawings.

DETAILED DESCRIPTION

Figure 1:
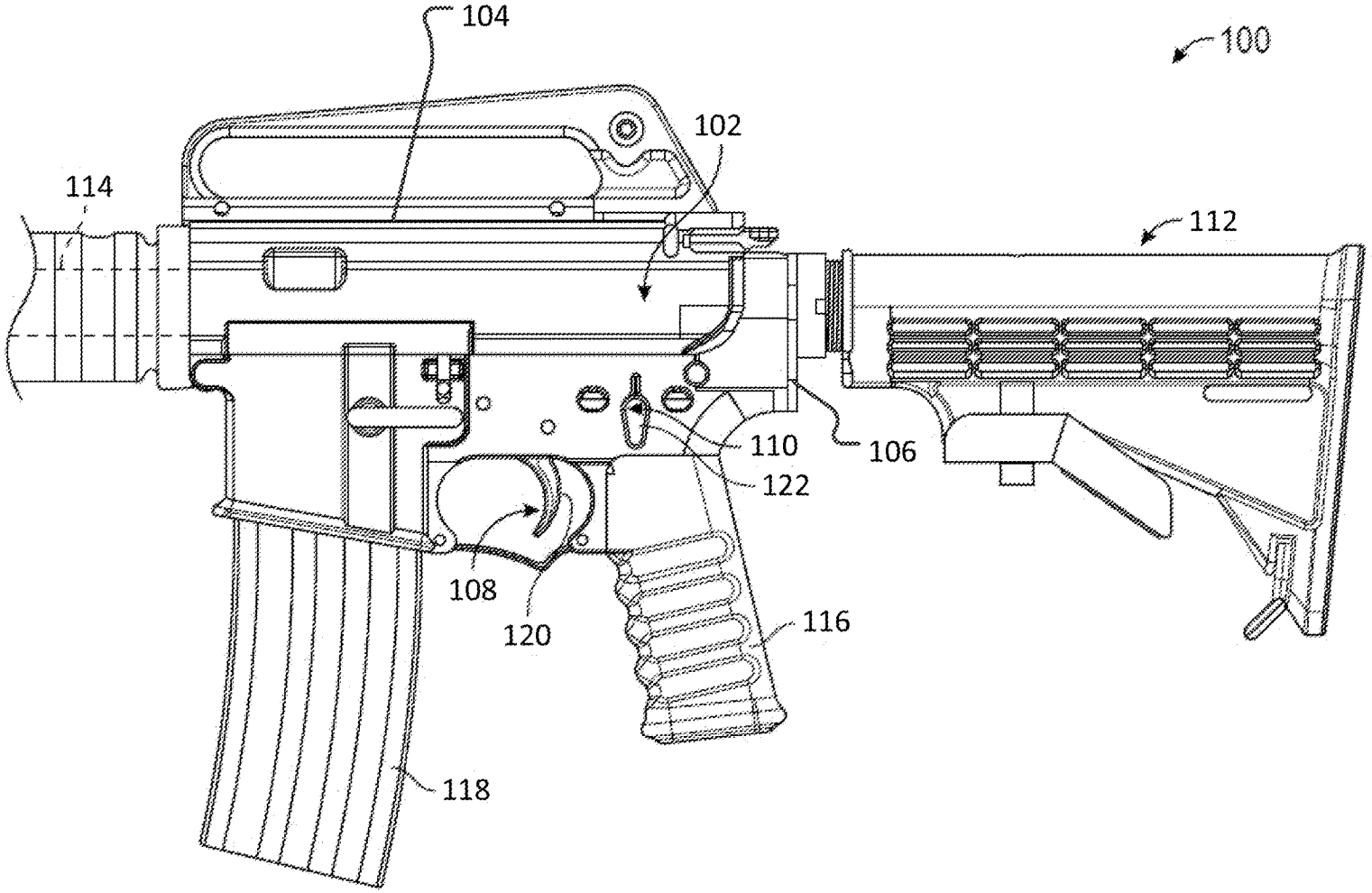
FIG. 1 is a schematic side view of an example firearm.

Various embodiments will be described in detail with reference to the drawings, wherein like reference numerals represent like parts and assemblies throughout the several views. Reference to various embodiments does not limit the scope of the claims attached hereto. Additionally, any examples set forth in this specification are not intended to be limiting and merely set forth some of the many possible embodiments for the appended claims.

Exemplary embodiments of a safety selector assembly for use with a firearm are described herein. The safety selector assembly enables the firearm to be switched between different operating modes and generally includes at least one lever removably attached to a cylinder body. The lever may be attached to the cylinder through a biased plunger that is secured to the cylinder by a pin. The pin enables the plunger to be depressed within the cylinder so as to facilitate attaching and/or detaching the lever. Additionally, the pin prevents the plunger from being removed from the cylinder so that when the lever is detached, the plunger does not eject from the cylinder. This is problematic since the components are small in size and more likely to become lost, especially in the field. Accordingly, the safety selector assembly as described herein decreases the time and effort required to install and/or remove it from the firearm. Additionally, specific levers (e.g., left and right handed levers) are enabled to be more easily changed out to accommodate more than one firearm user.

FIG. 1 is a schematic side view of an example firearm 100. In this example, the firearm 100 includes a receiver body 102 formed from an upper receiver 104 and a lower receiver 106, a trigger assembly 108, and a safety selector assembly 110. In some examples, the firearm 100 may also include a stock 112, a barrel 114, a grip 116, and an ammunition magazine 118.

The firearm 100 can be of a variety of types. Examples of the firearm may include, but are not limited to, handguns, rifles, shotguns, carbines, machine guns, submachine guns, personal defense weapons, semi-automatic rifles, and automatic rifles. In at least one example, the firearm is an AR-15, M-16, or M-4 type rifle, or one of their variants.

In the example, the firearm 100 is configured to have a plurality of operating modes. The operating modes may include at least one of a safe mode and a fire mode. When the firearm 100 is in the safe mode, the firearm is prevented from discharging a round or ammunition, while when the firearm 100 is in the fire mode, the firearm may be discharged each time that the trigger assembly 108 is activated. Other operating modes may also be present. In order to switch between the different operating modes, the safety selector assembly 110 can be used.

The receiver body 102 is configured to house a firing mechanism and associated components as found in, for example, rifles and their variants. The firing mechanism includes the trigger assembly 108 that is at least partially housed in the lower receiver 106, and a bolt assembly (not shown) that is slidably disposed in the upper receiver 104 for axially reciprocating recoil movement therein during a firing cycle sequence of the firearm 100. The bolt assembly is operably interfaced with the trigger assembly 108.

The trigger assembly 108 includes a trigger bow 120 configured to be pulled by the finger of the user (e.g., the index finger) to initiate the firing cycle sequence of the firearm 100. In some examples, the trigger assembly 108 may be configured to provide a plurality of modes enabling different operation of the trigger assembly 108. One example of a multi-mode trigger assembly is described in U.S. Pat. No. 9,618,289, the disclosure of which is hereby incorporated by reference in its entirety.

The safety selector assembly 110 is rotatably coupled to and supported within the lower receiver 106 and is configured to facilitate the switching of the firearm 100 between different operating modes. As mentioned above, each operating mode alters the behavior of the firearm 100. In at least one example, the safety selector assembly 110 includes a lever 122 that enables the user to switch the safety selector assembly 110 between multiple positions, such as a fire mode position and a safe mode position. The safety selector assembly 110 is operably coupled to the trigger assembly 108 such that upon positioning of the lever 122, the trigger assembly 108 has a corresponding operating condition. In the example, the lever 122 may be disposed on the side of the lower receiver 106.

The stock 112 is configured to be positioned at the rearward portion of the firearm 100 and opposite the barrel 114. The stock 112 provides an additional surface for a user to support the firearm 100 with, such as against the user's shoulder. In some examples, the stock 112 includes a mount for a sling. In other examples, the stock 112 may be a telescoping stock. In yet other examples, the stock 112 may be foldable. In still other examples, the stock 112 may be removably mounted to the receiver body 102, such as by a threaded connection or a removable fastener connection.

The barrel 114 is positioned at the forward end of the firearm 100 and is configured to be installed to the receiver body 102. The barrel provides a path to release an explosion gas and propel a projectile therethrough. In some examples, the barrel 114 is at least partially surrounded by an accessory assembly that may include a rail system (not shown) for mounting accessories (e.g., a fore-grip, a flashlight, a laser, optic equipment, etc.) thereto. Only a portion of the barrel 114 is illustrated in FIG. 1.

The grip 116 provides a point of support for the user of the firearm 100 and can be held by the user's hand, including when operating the trigger assembly 108 and/or the safety selector assembly 110. The grip 116 can assist the user in stabilizing the firearm 100 during firing and manipulation of the firearm 100. In the example, the grip 116 is mounted to the lower receiver 106.

The ammunition magazine 118 is an ammunition storage and feeding device within the firearm 100. In some examples, the ammunition magazine 118 is detachably installed on the firearm. For example, the ammunition magazine 118 is removably inserted into a magazine well of the lower receiver 106 of the firearm 100.

Other examples of the firearm 100 may have other configurations and/or components than the examples illustrated and described with reference to FIG. 1. For example, in alternative examples, some of the components listed above are not included.

Figure 2:
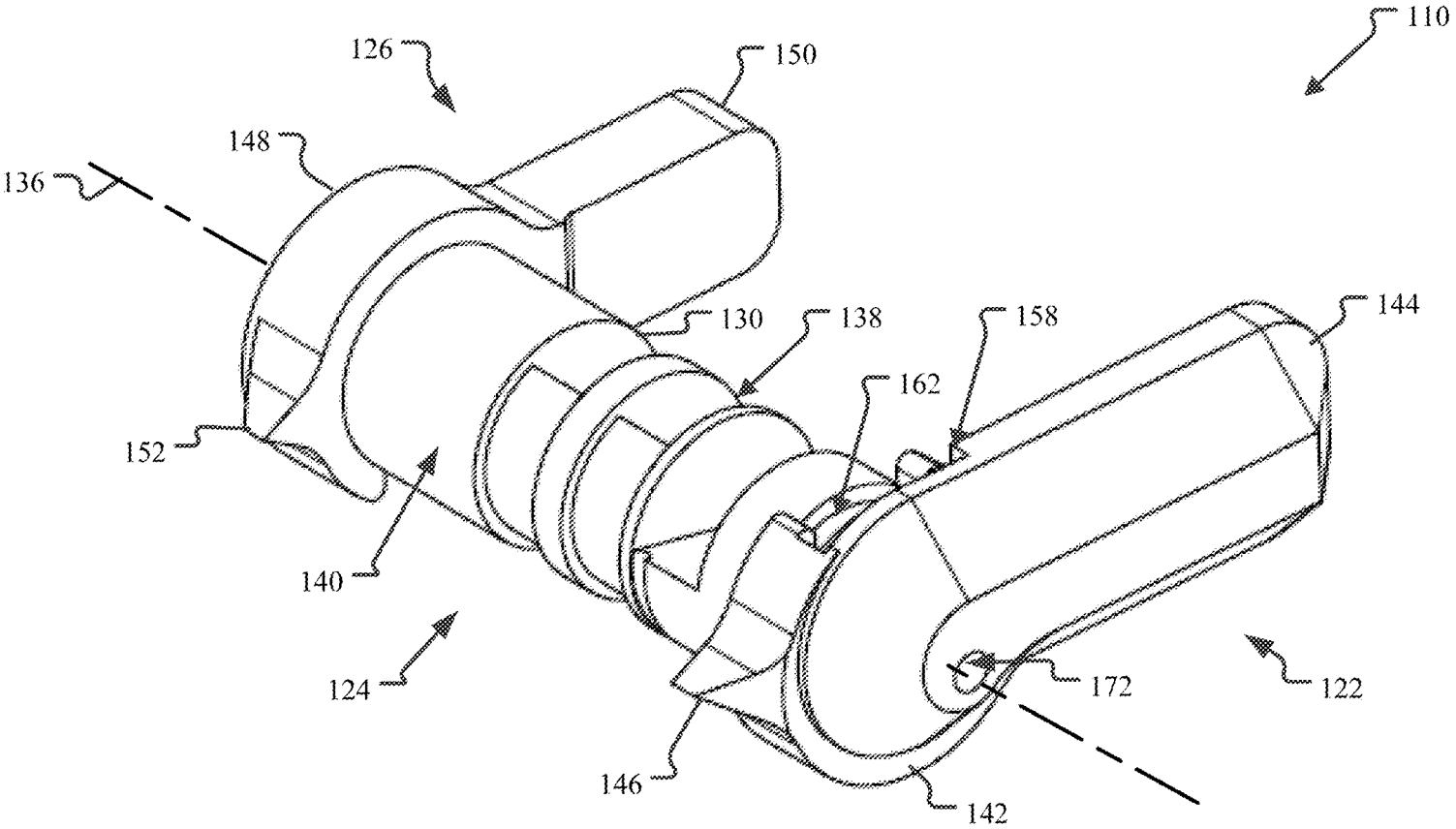
FIG. 2 is a perspective view of an example safety selector assembly of the firearm shown in FIG. 1, according to one embodiment of the present disclosure.
Figure 3:
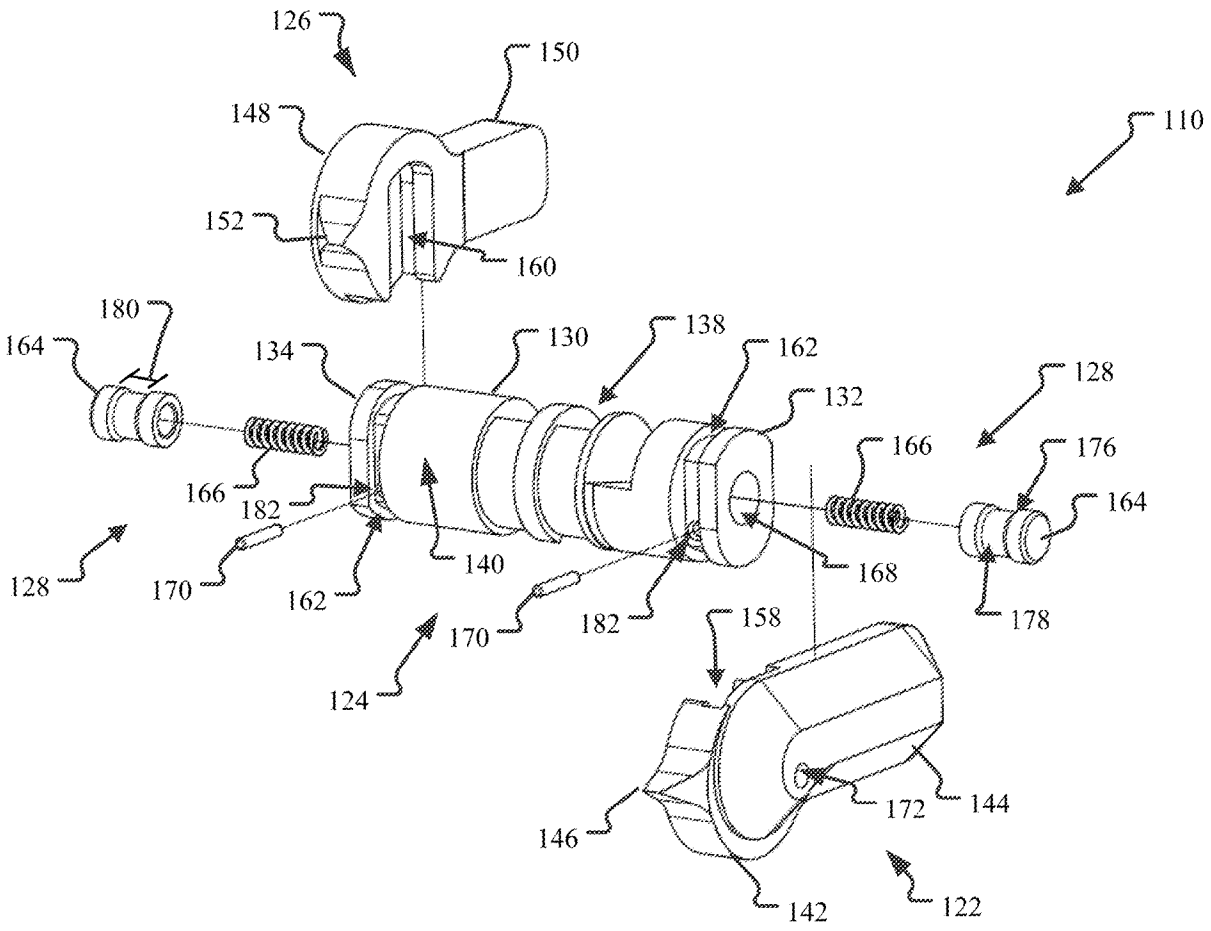
FIG. 3 is an exploded perspective view of the safety selector assembly shown in FIG. 2.
Figure 4:
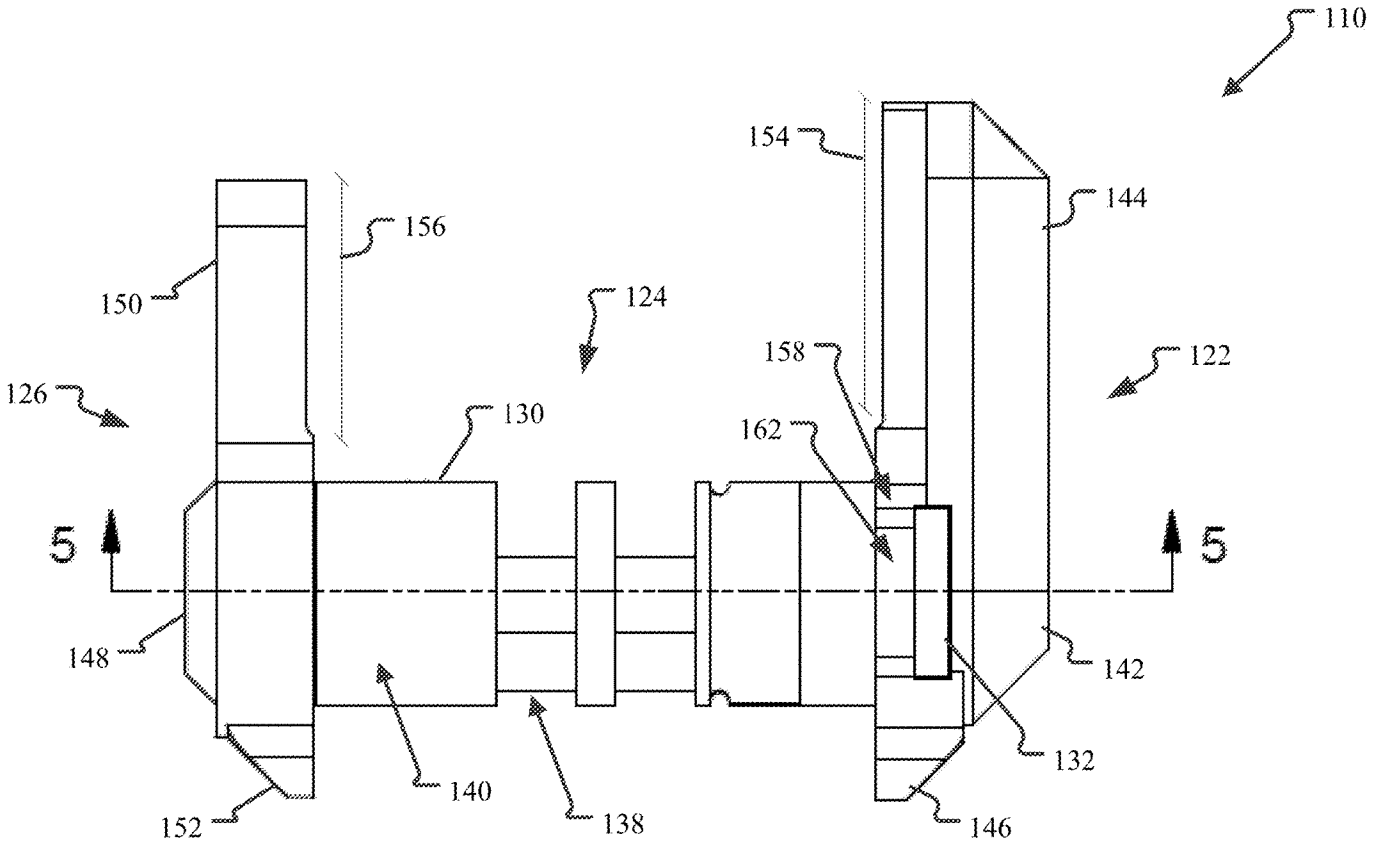
FIG. 4 is a top view of the safety selector assembly shown in FIG. 2.

FIG. 2 is a perspective view of the safety selector assembly 110 of the firearm 100 (shown in FIG. 1). FIG. 3 is an exploded perspective view of the safety selector assembly 110. FIG. 4 is a top view of the safety selector assembly 110. Referring concurrently to FIGS. 2-4, the safety selector assembly 110 includes a cylinder 124, a first lever 122, and a second lever 126. Each lever 122, 126 may be detachably coupled to the cylinder 124 by a plunger assembly 128. By enabling the removal of the levers 122, 126, the safety selector assembly 110 can be quickly and easily installed and/or removed from the lower receiver 106 as illustrated in FIG. 1.

The cylinder 124 is sized and shaped to be rotatably received within the lower receiver 106. The cylinder 124 is generally a cylindrical body 130 extending between a first cylinder end 132 and a second cylinder end 134 along a rotational axis 136. In the example, the cylinder body 130 may have one or more stopper portions 138 defined on an outer surface 140 of the cylinder 124. The stopper portions 138 are configured to selectively engage the trigger assembly 108 (shown in FIG. 1) so as to facilitate the switching of the firearm 100 between different operating modes as described above. One example of the configuration of a stopper portion is described in U.S. Pat. No. 9,618,289, the disclosure of which is hereby incorporated by reference in its entirety.

The first lever 122 is removably attached to the first cylinder end 132, and the second lever 126 is removably attached to the second cylinder end 134. The levers 122, 126 enable the cylinder 124 to be selectively rotated between different operational modes when mounted on the lower receiver 106 and engaged with the trigger assembly 108. As shown in FIG. 1, the levers 122, 126 are exposed along the side of the lower receiver 106 so that a user may rotate either lever 122, 126 and change the position of the safety selector assembly 110, switching the firearm between a plurality of different operating modes. In alternative examples, the safety selector assembly 110 may only include a single lever such that the safety selector assembly is accessible from one side of the lower receiver.

The first lever 122 includes a head portion 142 with a post portion 144 extending therefrom. The head portion 142 may also include a mode indicator 146 that can be used to indicate the operating mode of the trigger assembly 108 on the lower receiver 106. The second lever 126 also has a head portion 148 with a post portion 150 and a mode indicator 152 extending therefrom. The post portions 144, 150 enable the user to rotate the cylinder 124 and switch the firearm between a plurality of different operating modes from the exterior of the lower receiver 106. In the example, a length 154 of the first lever post portion 144 is greater than a length 156 of the second lever post portion 150. Different lever shapes and sizes may be used to facilitate a more efficient operation by the user. Additionally, lever shapes and positions may be changed out to facilitate a more efficient left and/or right hand operation by the user. As such, selectively configuring the levers 122, 126 of the safety selector assembly 110 enables the assembly 110 to be desirably operable for both left and right handed users. The safety selector assembly 110 enables a quick lever configuration change, so that different desired levers may be changed out and/or an opposite handed user can easily be accommodated with the same cylinder 124. In alternative examples, the first lever 122 may be similarly sized and shaped to the second lever 126.

The head portion 142 of the first lever 122 has a cutout 158 defined therein so that the first lever 122 may slidably engage with the first end 132 of the cylinder 124. The head portion 148 of the second lever 126 also has a cutout 160 defined therein so that the second lever 126 may slidably engage with the second end 134 of the cylinder 124. The cutouts 158, 160 are sized and shaped to correspond to the cylinder ends 132, 134, such that a portion of the cylinder 124 is received therein. The cylinder 124 may include a plurality of annular channels 162 defined within the cylinder body 130 and positioned adjacent to and offset from each cylinder end 132, 134. The annular channels 162 receive a portion of the cutouts 158, 160 so that each lever 122, 126 can be removably secured to the cylinder 124 via the plunger assembly 128. The annular channels 162 and the cutouts 158, 160 are sized and shaped to correspond to one another so that the levers 122, 126 cannot be pulled out from the cylinder 124 along the rotational axis 136.

The plunger assembly 128 includes a plunger 164 and a biasing element 166 disposed at least partially within the cylinder 124. Each end 132, 134 of the cylinder 124 includes a plunger recess 168 extending along the rotational axis 136. The plunger recess 168 is sized and shaped to receive the plunger 164 and biasing element 166 so that the plunger 164 is biased along the rotational axis 136 via the biasing element 166. In the example, the biasing element 166 is a spring. In other examples, the biasing element 166 may have any other configuration that enables the plunger 164 to operate as described herein. The plunger 164 is moveably secured within the plunger recess 168 by a pin 170 so that the plunger 164 enables the levers 122, 126 to be removably coupled to the cylinder 124. The plunger 164 engages with the levers 122, 126 so that the levers 122, 126 cannot be slid out of the cylinder ends 132, 134 in a radial direction from the rotational axis 136 without disengaging the plunger 164 first.

In operation, the biasing element 166 biases the plunger 164 within the plunger recess 168. To couple the levers 122, 126 to the cylinder 124, the plunger 164 is depressed within the plunger recess 168 along the rotational axis 136. The head portions 142, 148 are then slid into place, e.g., the cylinder ends 132, 134 are received within the cutouts 158, 160, until the plunger 164 engages with the head portions 142, 148 and snaps into place because of the biasing element 166 biasing the plunger 164. To remove the levers 122, 126 from the cylinder 124, the plunger 164 is depressed along the rotational axis 136 within the plunger recess 168. This may be performed by an elongated tool (not shown) being extended through openings 172, 174 (shown in FIG. 5) defined within the head portions 142, 148 so that the plunger 164 can be depressed and disengaged from the head portions 142, 148. The levers 122, 126 may then be slid off of the cylinder 124, e.g., in a radial direction from the rotational axis 136.

If the plunger 164 and biasing element 166 are not secured within the plunger recess 168, when the levers 122, 126 are removed, the plunger 164 and/or the biasing element 166 may eject out of the plunger recess 168 due to the compression of the biasing element quickly releasing and launching the plunger 164 out of the plunger recess 168. This is problematic since these components are small in size and more likely to become lost, thereby increasing the time and effort required to install and/or remove the safety selector assembly 110 from the lower receiver 106. To avoid this problem, the pin 170 is used to secure the plunger 164 to the cylinder 124 and prevent the plunger 164 and the biasing element 166 from undesirably coming out of the plunger recess 168 during installation and/or removal.

In the example, the plunger 164 is generally cylindrical and has an outer surface 176 with an annular groove 178 defined therein. When the pin 170 is inserted into the cylinder body 130, a portion of the pin 170 extends within the annular groove 178 so as to retain the plunger 164 within the plunger recess 168. The annular groove 178 extends for a length 180 along the rotational axis 136 so that the plunger 164 may still be movable within the plunger recess 168 and facilitate coupling and decoupling the levers 122, 126 from the cylinder 124 as described above. The length 180 of the annular groove 178 defines the amount of movement the plunger 164 has within the plunger recess 168. In an alternative example, the plunger 164 may have an elongated slot defined on the outer surface 176 so as to receive the pin 170 and retain the plunger 164 within the plunger recess 168.

The cylinder body 130 has a plurality of openings 182 defined on each cylinder end 132, 134 that are sized and shaped to receive and support the pins 170. In the example, the openings 182 extend the entire way through the cylinder body 130 so that the pins 170 may be removed and release the plunger 164 and the biasing element 166 from the plunger recess 168. The openings 182 are also positioned within the annular channel 162 so that the levers 122, 126 cover the openings 182 when the safety selector assembly 110 is assembled to prevent the pins 170 from being undesirably extracted from the openings 182.

Figure 5:
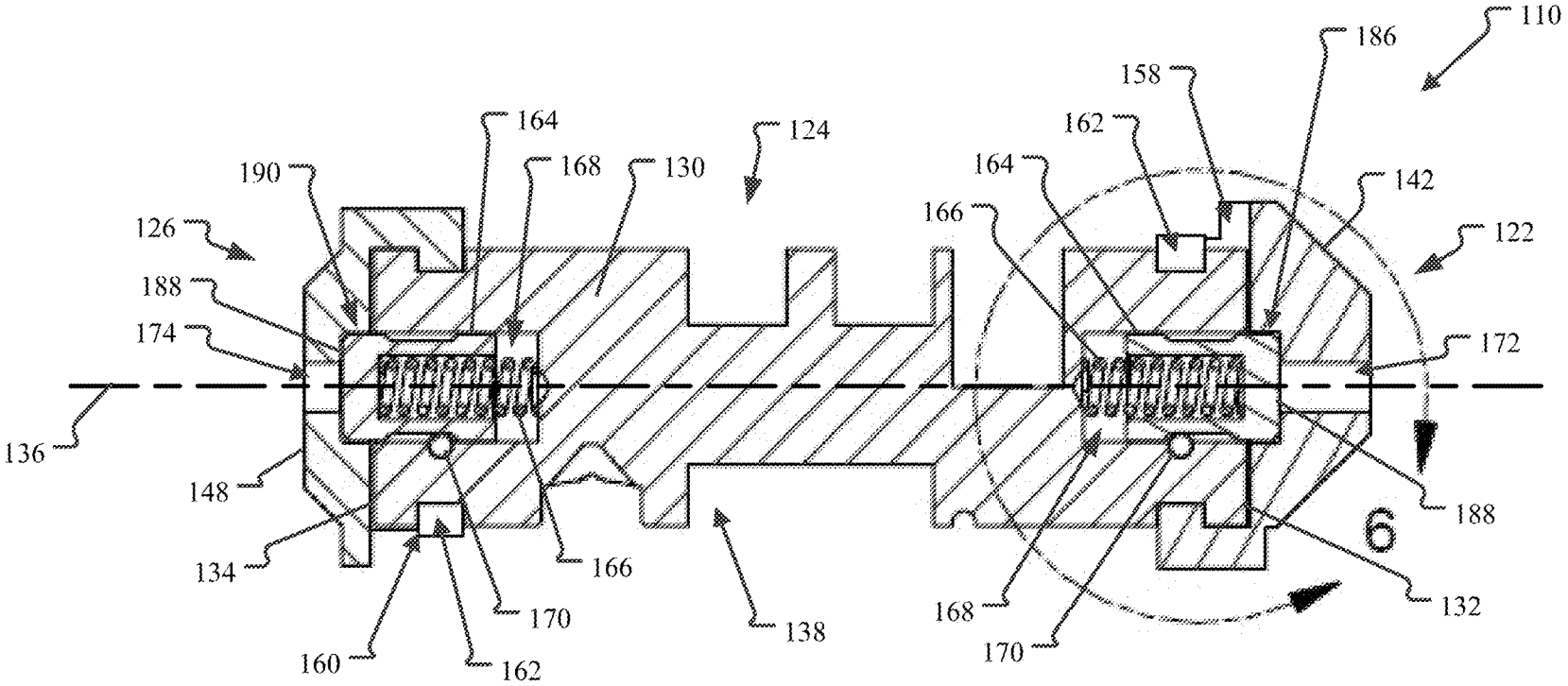
FIG. 5 is a cross sectional view of the safety selector assembly shown in FIG. 2, taken along the line 5-5 in FIG. 4.
Figure 6:
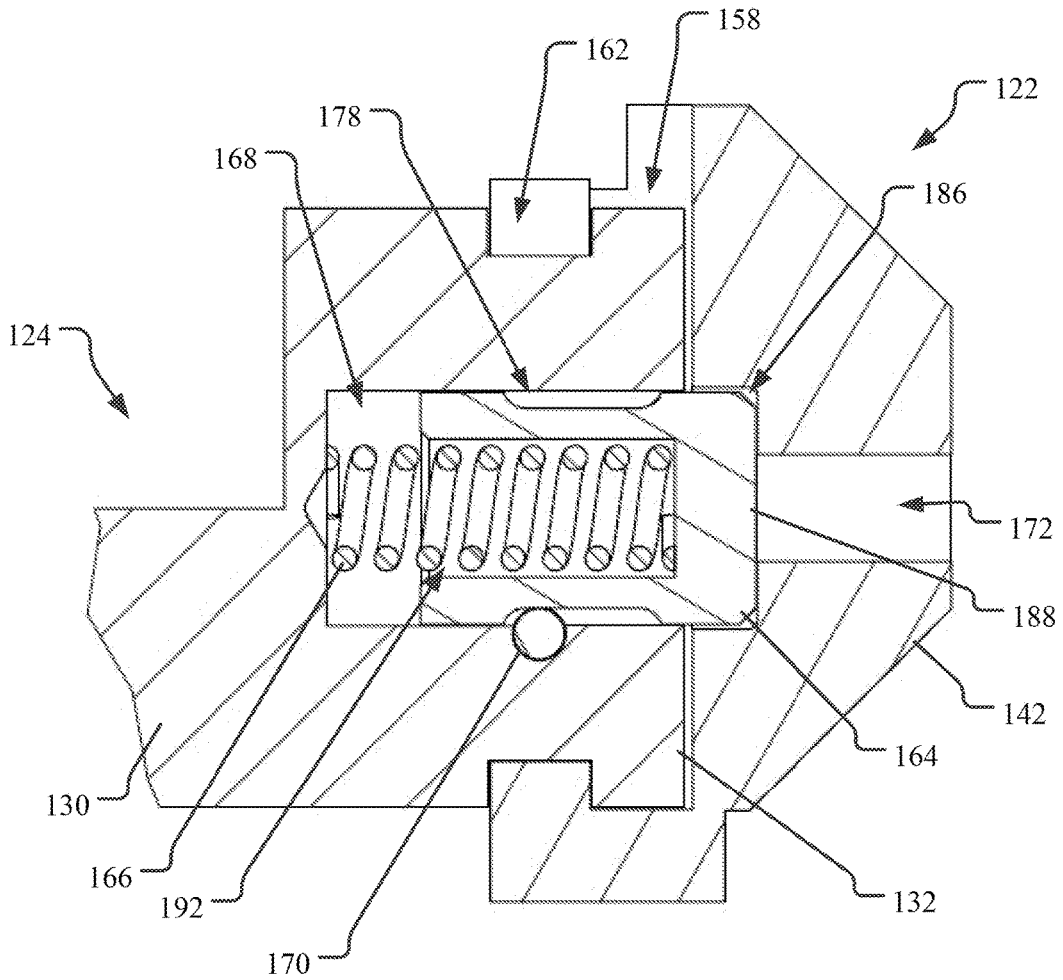
FIG. 6 is a detailed cross sectional view of the safety selector assembly shown in FIG. 2, taken along the area 6 in FIG. 5.

FIG. 5 is a cross sectional view of the safety selector assembly 110, taken along the line 5-5 in FIG. 4. FIG. 6 is a detailed cross sectional view of the safety selector assembly 110, taken along the area 6 in FIG. 5. Referring concurrently to FIGS. 5 and 6, the levers 122, 126 are coupled to the cylinder 124 via the biased plungers 164 disposed on each end 132, 134 of the cylinder body 130. The first lever 122 has a cutout 158 on the head portion 142 that receives the first cylinder end 132 and slides at least partially within the annular channel 162. At the head portion 142 of the first lever 122, a plunger recess 186 is defined between the cutout 158 and the opening 172 that receives a head 188 of the plunger 164 to secure the first lever 122 onto the cylinder 124.

Similarly, the second lever 126 has a cutout 160 on the head portion 148 that receives the second cylinder end 134 and slides at least partially within the annular channel 162. At the head portion 148 of the second lever 126, a plunger recess 190 is defined between the cutout 160 and the opening 174 that receives the head 188 of the plunger 164 to secure the second lever 126 onto the cylinder 124. The plunger 164 is biased by the biasing element 166 so as to extend the head 188 out of the plunger recess 168. This enables the plunger 164 to snap into and engage the levers 122, 126 and prevent the levers 122, 126 from sliding off of the cylinder 124.

The openings 172, 174 on each lever 122, 126 enable the plunger 164 to be depressed from the exterior, for example, by an elongated tool (not shown), so as to disengage the plungers 164 from the plunger recesses 186, 190. When the plungers 164 are disengaged from the levers 122, 126, the levers 122, 126 may then be removed from the cylinder 124. The pin 170 keeps the plunger 164 secured to the cylinder 124 so that the plunger 164 and the biasing element 166 are not lost during installation and/or removal of the safety selector assembly 110.

The plunger 164 has a cavity 192 opposite the head 188 which partially receives the biasing element 166 so that the plunger 164 is biased along the rotational axis 136. In the example, the pin 170 extends in a direction that is substantially orthogonal to the rotational axis 136 such that the pin 170 extends within a portion of the annular groove 178. As such, the plunger 164 and the biasing element 166 are secured within the plunger recess 168 of the cylinder 124. As used herein, the term "substantially" means to a significant extent. For instance, when a component is described as being "substantially orthogonal" to another component, this term refers to the components being at an angle of approximately 90° to each other. In other examples, the pin 170 may be oriented at an angle within a range of 45°-90° (e.g., 60°, 75°, 80°, or 85°) to the rotational axis 136.

The length 180 (shown in FIG. 3) of the annular groove 178 is also much longer than the diameter of the pin 170, thus enabling the plunger 164 to move along the rotational axis 136 while still being secured within the plunger recess 168. In alternative examples, the pin 170 may be oriented in any other direction that enables the plunger to function as described herein.

Figure 7A:
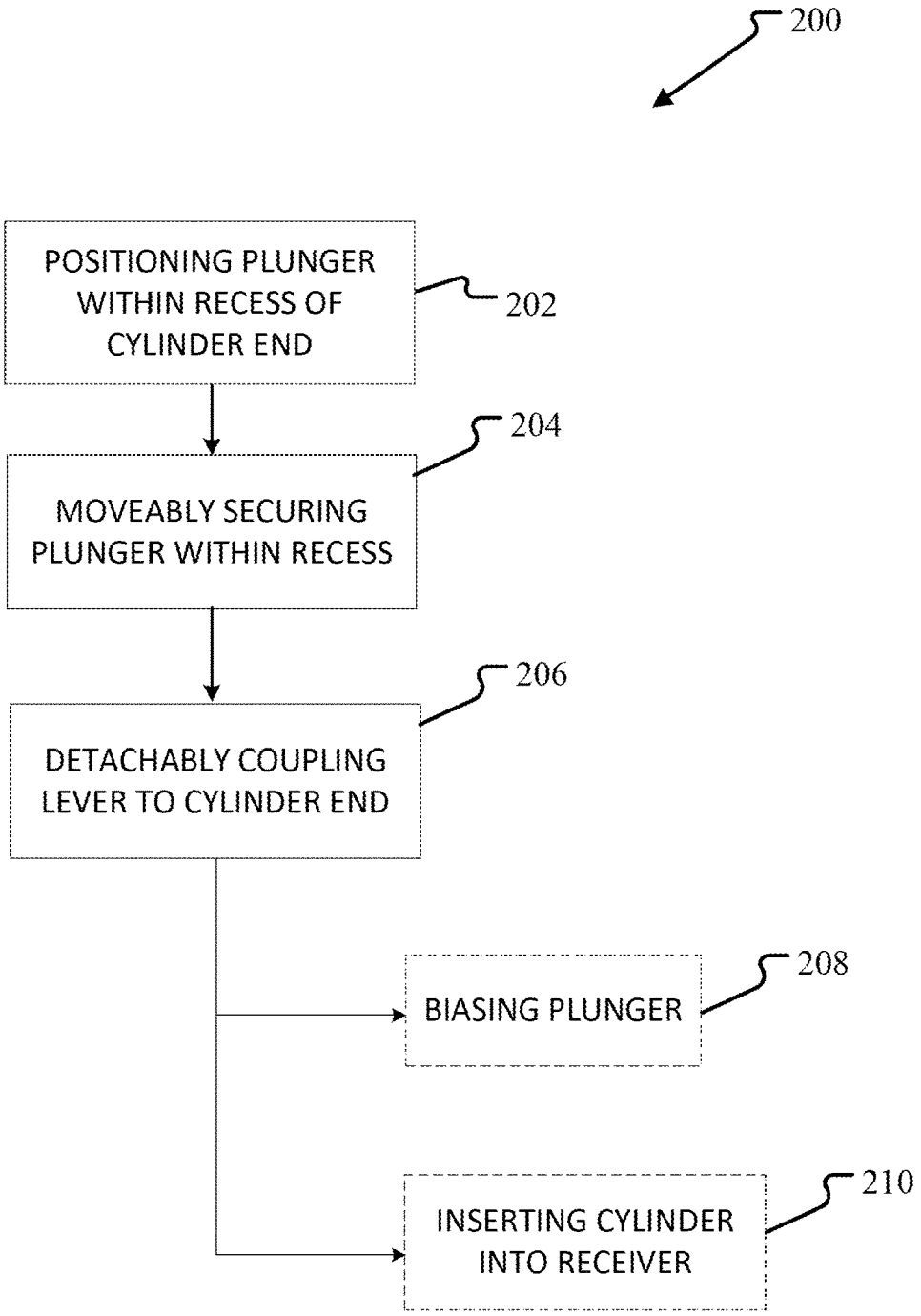
FIGS. 7A-7C are flowcharts illustrating an example method of assembling the safety selector assembly shown in FIG. 2.
Figure 7C:
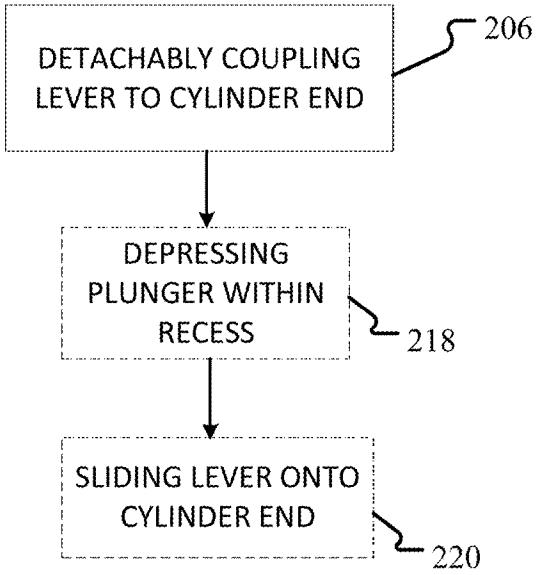
Figure 7B:
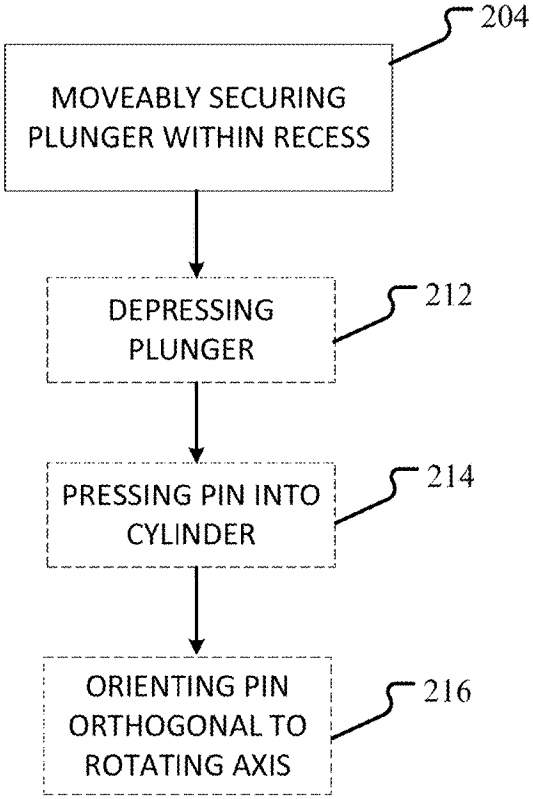

FIGS. 7A-7C are flowcharts illustrating an example method 200 of assembling the safety selector assembly. Beginning with FIG. 7A, to assemble the safety selector assembly, a plunger is positioned at least partially within a recess that is defined in a cylinder end of a cylinder (operation 202). A pin can be used to moveably secure the plunger within the recess (operation 204). Then a lever is detachably coupled to the cylinder end via the plunger (operation 206).

In one example, the cylinder defines a rotational axis and the method 200 can further include the plunger being biased along the rotational axis within the recess (operation 208). For example, a biasing element inserted at least partially into the plunger may be used to bias the plunger within the recess. In another example, the method 200 may further include at least a portion of the cylinder being inserted into a receiver of the firearm (operation 210).

Turning to FIG. 7B, in other examples, to movably secure the plunger within the recess (operation 204), the plunger is depressed within the recess (operation 212) and then the pin is press fit into the cylinder such that the pin at least partially extends within an annular groove defined on the plunger (operation 214). The pin secures the plunger within the recess while still enabling the plunger to be moveably depressed within the recess. In still other examples, the pin may be oriented substantially orthogonally to the rotational axis of the cylinder (operation 216).

Turning to FIG. 7C, in still further examples, to detachably couple the lever to the cylinder (operation 206), the plunger may be depressed within the recess (operation 218) and then a head portion of the lever is slid onto the cylinder end till the plunger clicks in place (operation 220). This example method may also be repeated for attaching a second lever to the cylinder.

Figure 8:
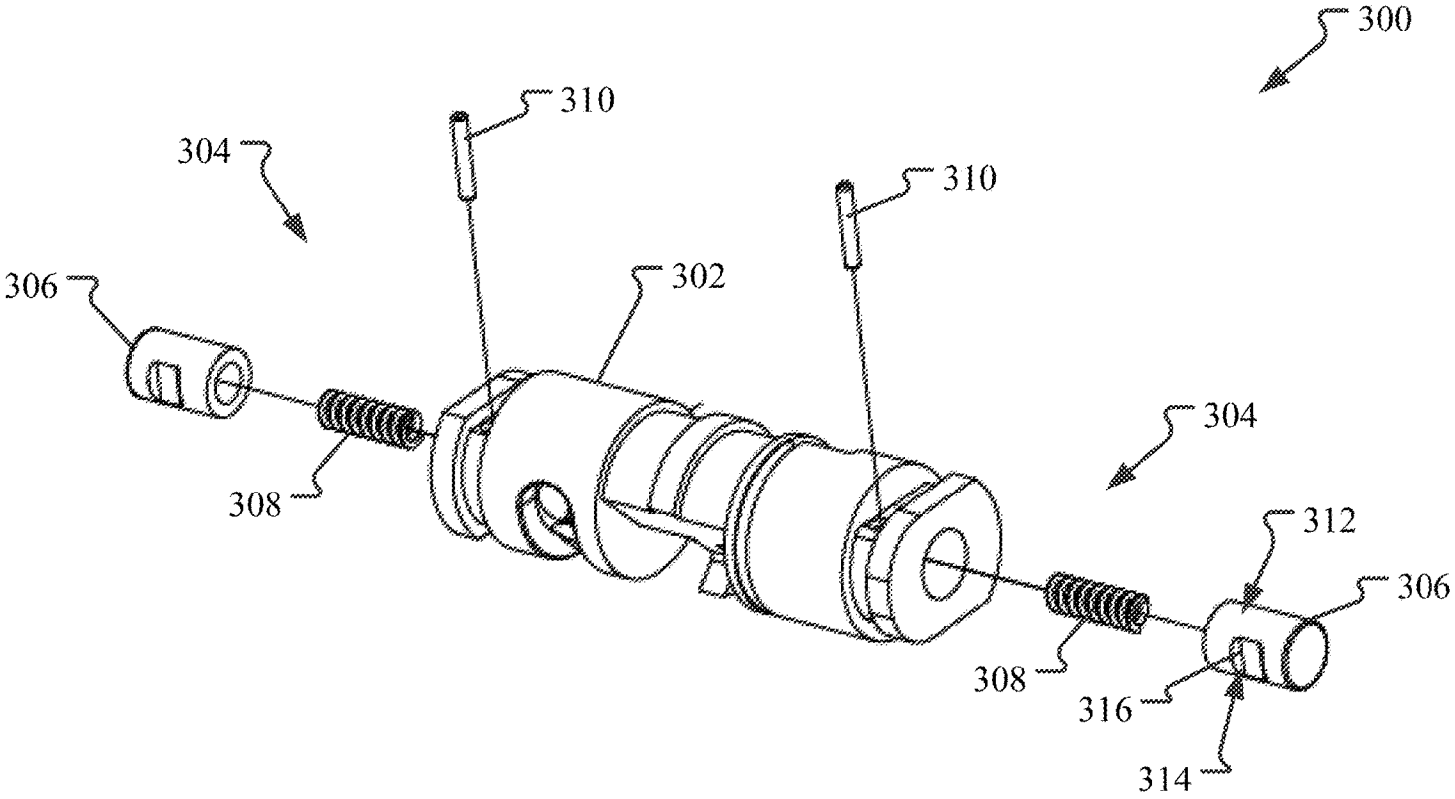
FIG. 8 is an exploded partial-perspective view of an example safety selector assembly that may be used with the firearm shown in FIG. 1 according to another embodiment of the present disclosure.

FIG. 8 is an exploded partial-perspective view of another safety selector assembly 300 that may be used with the firearm 100 (shown in FIG. 1). Similar to other examples described herein, the safety selector assembly 300 includes a cylinder 302 in which one or more levers (not shown) may be removably coupled thereto by a plunger assembly 304. The plunger assembly 304 includes a plunger 306, a biasing element 308, and a pin 310. However, in this example, the plunger 306 has an outer surface 312 with a cutout 314 defined therein. The cutout 314 does not extend annularly around the plunger 306. Rather, the cutout 314 is defined by a cord surface 316. When the pin 310 is inserted into the cylinder 302, a portion of the pin 310 extends within the cutout 314 so as to retain the plunger 306 at least partially within the cylinder 302 as described herein.

Figure 9B:
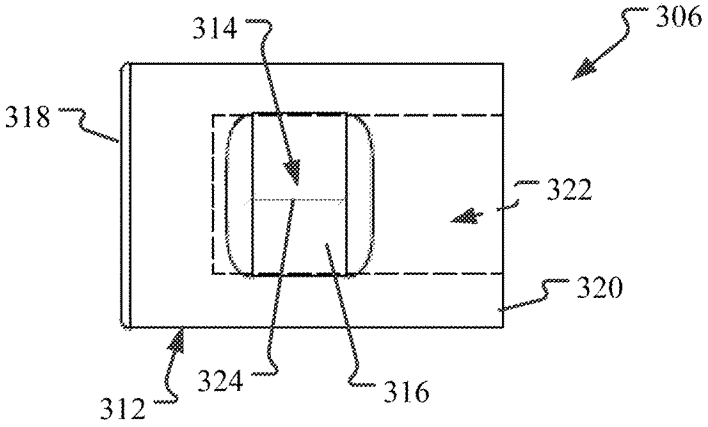
FIG. 9B is a side view of the plunger shown in FIG. 9A.
Figure 9C:
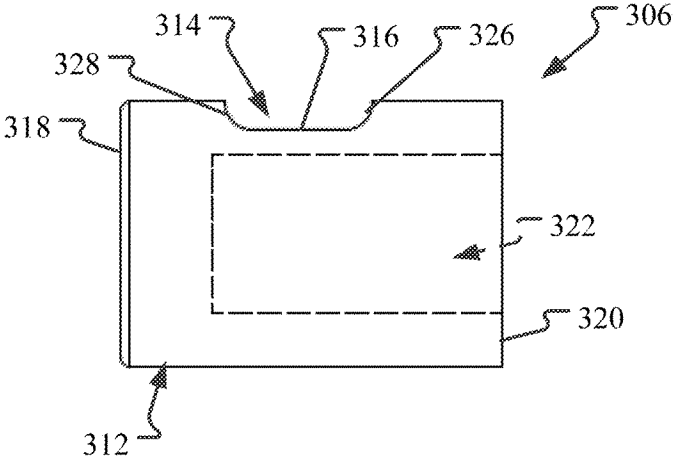
FIG. 9C is another side view of the plunger shown in FIG. 9A.
Figure 9A:
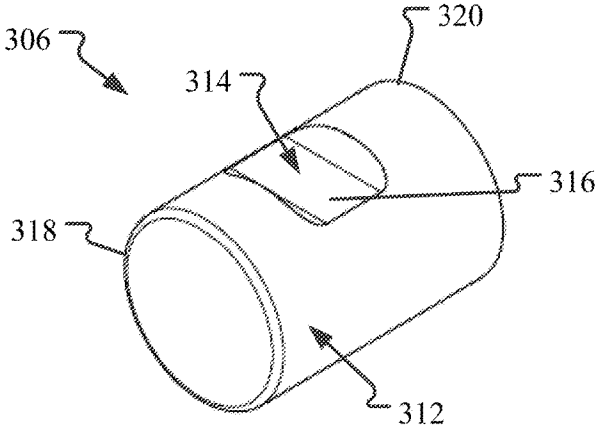
FIG. 9A is a perspective view of a plunger of the safety selector assembly shown in FIG. 8.

FIG. 9A is a perspective view of the plunger 306 of the safety selector assembly 300 (shown in FIG. 8). FIG. 9B is a side view of the plunger 306. FIG. 9C is another side view of the plunger 306. Referring concurrently to FIGS. 9A-9C, the plunger 306 is generally cylindrical-shaped with a head portion 318 configured to engage the lever and an opposite tail portion 320 configured to receive the biasing element 308 (shown in FIG. 8). A cavity 322 is defined within the tail portion 320 that receives at least a portion of the biasing element 308. When the plunger 306 is secured to the cylinder 302, the biasing element 308 is also secured to the cylinder 302 because it is at least partially housed within the cavity 322.

A portion of the outer surface 312 of the plunger 306 is defined with a cutout 314. The cutout 314 is formed by the cord surface 316 which is a cord of the cylindrical-shaped plunger 306. The cutout 314 extends for a length 324 so that the plunger 306 is movable when secured to the cylinder 302 (shown in FIG. 8). Both ends 326, 328 of the cutout 314 may be curved so as to correspond to the shape of the pin 310 (shown in FIG. 8). In alternative examples, the plunger may have two or more cutouts circumferentially spaced around the outer surface.

The various embodiments described above are provided by way of illustration only and should not be construed to limit the claims attached hereto. Those skilled in the art will readily recognize various modifications and changes that may be made without following the example embodiments and application illustrated and described herein, and without departing from the true spirit and scope of the following claims.

What is claimed is:

1. A safety selector assembly for a firearm, comprising:
- a cylinder sized and shaped to be rotatably received within a lower receiver, the cylinder comprising a cylinder end having a recess defined therein;
- a plunger disposed at least partially within the recess, wherein the plunger is moveably secured within the recess by a pin; and
- a lever detachably coupled to the cylinder end by the plunger.

2. The safety selector assembly of claim 1, wherein the cylinder defines a rotational axis and the recess extends along the rotational axis.

3. The safety selector assembly of claim 2, wherein the plunger is biased along the rotational axis within the recess by a biasing element.

4. The safety selector assembly of claim 3, wherein the lever comprises a head portion having a plunger recess defined therein, and wherein when the head portion is coupled to the cylinder end at least a portion of the plunger extends into the plunger recess so as to secure the lever to the cylinder.

5. The safety selector assembly of claim 2, wherein the pin extends in a direction that is substantially orthogonal to the rotational axis.

6. The safety selector assembly of claim 3, wherein the pin prevents the plunger and the biasing element from being removed from the recess.

7. The safety selector assembly of claim 1, wherein the plunger comprises an outer surface having an annular groove defined therein, the annular groove receiving at least a portion of the pin so as to moveably secure the plunger within the recess.

8. The safety selector assembly of claim 7, wherein the annular groove has a length defined along a rotational axis of the cylinder, and wherein the length of the annular groove defines the amount of movement of the plunger when secured within the recess.

9. The safety selector assembly of claim 1, wherein an opening sized and shaped to support the pin is defined within the cylinder.

10. The safety selector assembly of claim 9, wherein the opening extends through the cylinder.

11. The safety selector assembly of claim 9, wherein the cylinder further comprises an annular channel adjacent to the cylinder end, and wherein the opening is positioned within the annular channel.

12. The safety selector assembly of claim 1, wherein the cylinder end is a first cylinder end and the cylinder further comprises an opposite second cylinder end having a second recess defined therein, and wherein the safety selector assembly further comprises:
- a second plunger disposed at least partially within the second recess, wherein the second plunger is moveably secured within the second recess by a second pin; and
- a second lever detachably coupled to the second cylinder end by the second plunger.

13. A firearm comprising:
- a lower receiver configured to house a trigger assembly; and
- a safety selector assembly rotatably supported at least partially within the lower receiver, wherein the safety selector assembly is operably coupled to the trigger assembly, the safety selector comprising:
  - a cylinder defining a rotational axis and comprising a cylinder end having a recess defined therein;
  - a plunger biased at least partially within the recess, wherein the plunger is moveably secured within the recess by a pin; and
  - a lever detachably coupled to the cylinder end by the plunger, wherein the lever is disposed on an exterior of the lower receiver when the safety selector is rotatably coupled thereto.

14. The firearm of claim 13, wherein the pin is supported by the cylinder and is oriented substantially orthogonal to the rotational axis.

15. A method of assembling a safety selector assembly for a firearm comprising:
- positioning a plunger at least partially within a recess defined in a cylinder end of a cylinder, wherein the cylinder is sized and shaped to be rotatably received within a lower receiver;
- moveably securing the plunger within the recess by a pin; and
- detachably coupling a lever to the cylinder end via the plunger.

16. The method of claim 15, wherein the cylinder defines a rotational axis and the method further comprises biasing the plunger along the rotational axis within the recess.

17. The method of claim 16, wherein moveably securing the plunger within the recess further comprises:

depressing the plunger within the recess; and pressing the pin into the cylinder such that the pin at least partially extends within an annular groove defined on the plunger.

18. The method of claim 17, wherein pressing the pin into the cylinder further comprises orienting the pin substantially orthogonally to the rotational axis.

19. The method of claim 15, wherein detachably coupling the lever to the cylinder further comprises:

depressing the plunger within the recess; and sliding a head portion of the lever onto the cylinder end.

20. The method of claim 15 further comprising inserting at least a portion of the cylinder into a receiver of the firearm.

* * * * *